United States Patent [19]

Davidson

[11] 4,434,729

[45] Mar. 6, 1984

[54] CONTINUOUS MONOGRAMMER

[75] Inventor: Donald R. Davidson, Berkeley Heights, N.J.

[73] Assignee: The Singer Company, Stamford, Conn.

[21] Appl. No.: 221,098

[22] Filed: Dec. 29, 1980

[51] Int. Cl.[3] ..... D05B 21/00

[52] U.S. Cl. ..... 112/121.12; 112/158 E; 112/304; 112/320

[58] Field of Search ..... 112/121.12, 121.15, 112/102, 103, 158 E, 304, 320

[56] References Cited

U.S. PATENT DOCUMENTS

| | | | |
|---|---|---|---|
| 3,448,705 | 6/1969 | Scherr et al. | 112/102 X |
| 3,830,175 | 8/1974 | Levor | 112/121.12 |
| 4,309,950 | 1/1982 | Franklin | 112/121.12 X |
| 4,325,313 | 4/1982 | Kawai et al. | 112/103 |
| 4,325,315 | 4/1982 | Totino et al. | 112/158 E X |

*Primary Examiner*—Peter P. Nerbun

*Attorney, Agent, or Firm*—Edward P. Schmidt; Robert E. Smith; Edward L. Bell

[57] ABSTRACT

A work manipulating mechanism for a sewing machine attachable to the presser bar thereof which utilizes a pair of spaced apart endless belts on a first drive plate to feed an endless quantity of work material through a sewing machine in the formation of an ornamental pattern or monogramming, the first drive plate being shiftable in an orthogonal direction by a second drive plate attachable to the presser bar of a sewing machine. The first drive plate may be shifted by a rack and pinion connection to a stepper motor supported on the second drive plate, and the work material may be shifted by a stepper motor connected to one of a pair of shafts carrying sprockets encircled by the endless belts in contact with the work material.

5 Claims, 5 Drawing Figures

CONTINUOUS MONOGRAMMER

BACKGROUND OF THE INVENTION

This invention relates to a mechanism mountable on sewing machine for the purpose of moving a work material for stitching thereon words, patterns or monograms.

Prior art devices for monogramming or continuous patterning have been limited by the bight capability of the sewing machine. Thus, for example in the Japanese Patent Publication No. 49578/74 (Dec. 27, 1974, Taketomi) there is shown a device which may be operated by the needle bar of the sewing machine to feed a work material beneath a sewing needle in order to generate a continuous pattern having a width equal to the bight capability of the sewing machine.

In other prior art devices, a form of an embroidery hoop is utilized to support the work material beneath the sewing machine, and move the work material in the formation of larger patterns or writings. Such devices are shown in the U.S. Pat. Nos. 4,195,581 and 3,734,038 of Ohara and Taketomi, respectively.

What is not disclosed in the prior art and what is required is a device which may be utilized to form enlarged continuous ornamental patterns for decorative purposes on articles of manufacture, or enlarged monograms or words and phrases thereon.

SUMMARY OF THE INVENTION

The above objective is achieved in the continous monogramming device which is attachable to the presser bar of a sewing machine and operates to feed work material through the sewing machine continuously, and reversibly, in one direction while manipulating the work material over a wide range in a direction normal to the first direction. In a first embodiment, a Y axis drive plate is attached to the sewing machine presser bar and supports thereon a stepper motor driving a helical gear. The Y axis drive plate is fashioned with a channel to straddle a rack on an X axis drive plate, which rack the helical gear meshes with. The X axis drive plate is fashioned with a pair of laterally extending upstanding ears which support on the extremities thereof a pair of shafts extending therebetween and carried on bushings supported thereby. Supported on the shafts adjacent the upstanding ears are sprocket wheels which carry feed belts for feeding a work material as desired endlessly in a lateral X, direction under the urgings of a stepper motor geared to one of the shafts. Under the urgings of the Y axis stepper motor the X axis drive plate moves in the longitudinal direction under the sewing needle of the machine approximately 3" in the formation of elements of a large letter, monogram, word, phrase or sentence. Control of the stepper motors and of the sewing instrumentalities of the sewing machine may be implemented by electronic means within the sewing machine frame or by auxiliary electronic means externally thereof having a connection to a stitch cycle sensor in the sewing machine to release data at the proper time.

In a second embodiment, work material may be endlessly fed in the longitudinal direction through the sewing machine with lateral location of the feeding plate by means of an X axis drive plate supported on the presser bar. In this embodiment a more compact profile is obtained which will enable circular goods such as a sleeve, to be inserted about a sewing machine cylinder bed.

DESCRIPTION OF THE DRAWINGS

The novel features which are considered as characteristic for the invention are set forth in particular in the appended claims. This invention itself, however, both as to its construction and its method of operation, together with additional objects and advantages thereof, will best be understood from the following description of specific embodiments when read in conjunction with the accompanying drawings in which:

Referring now to FIG. 1 there is shown a sewing machine 10 in which a bed 12 supports a standard 14 rising from one end thereof to support an arm 16 overhanging the bed and terminating in a head end 18. Within the head end 18 there is supported, as is well known in the sewing machine art, a presser bar 20 and a needle bar 24. A monogrammer assembly 30 is carried by the bed 12 and is connected to the presser bar 20.

Referring now to FIG. 2 there is shown in greater detail the monogrammer assembly 30 and its connection to the presser bar 20. The monogrammer assembly 30 includes a Y axis drive plate 32 which may be fashioned from sheet metal with a channel 34, an upturned lug 36 for attachment to the presser bar 20 by means of presser bar screw 21, and a support platform 40 with upturned ears 41 to accommodate a Y axis stepper motor 44. The Y axis drive plate 32 has attached thereto a shaft support 42 to support the end of the shaft 46 extending from the stepper motor 44. The shaft 46 has affixed thereon a gear 48 which revolves with the shaft when urged by the stepper motor 44 through signals from an electronic memory as will be explained below. In FIG. 3 there is shown a detail of the Y axis drive plate 32 indicating how a stripper foot 38 may be lanced out from the drive plate, the stripper foot being provided with an opening 39 through which the sewing needle 25 may step. The stripper foot 38 serves to retain the work material in a position adjacent a darning plate 49, which darning plate defeats the usual feeding motions of a work feeding dog (not shown) so as to make the feeding motions of the monogrammer assembly 30 effective.

Figure 1:
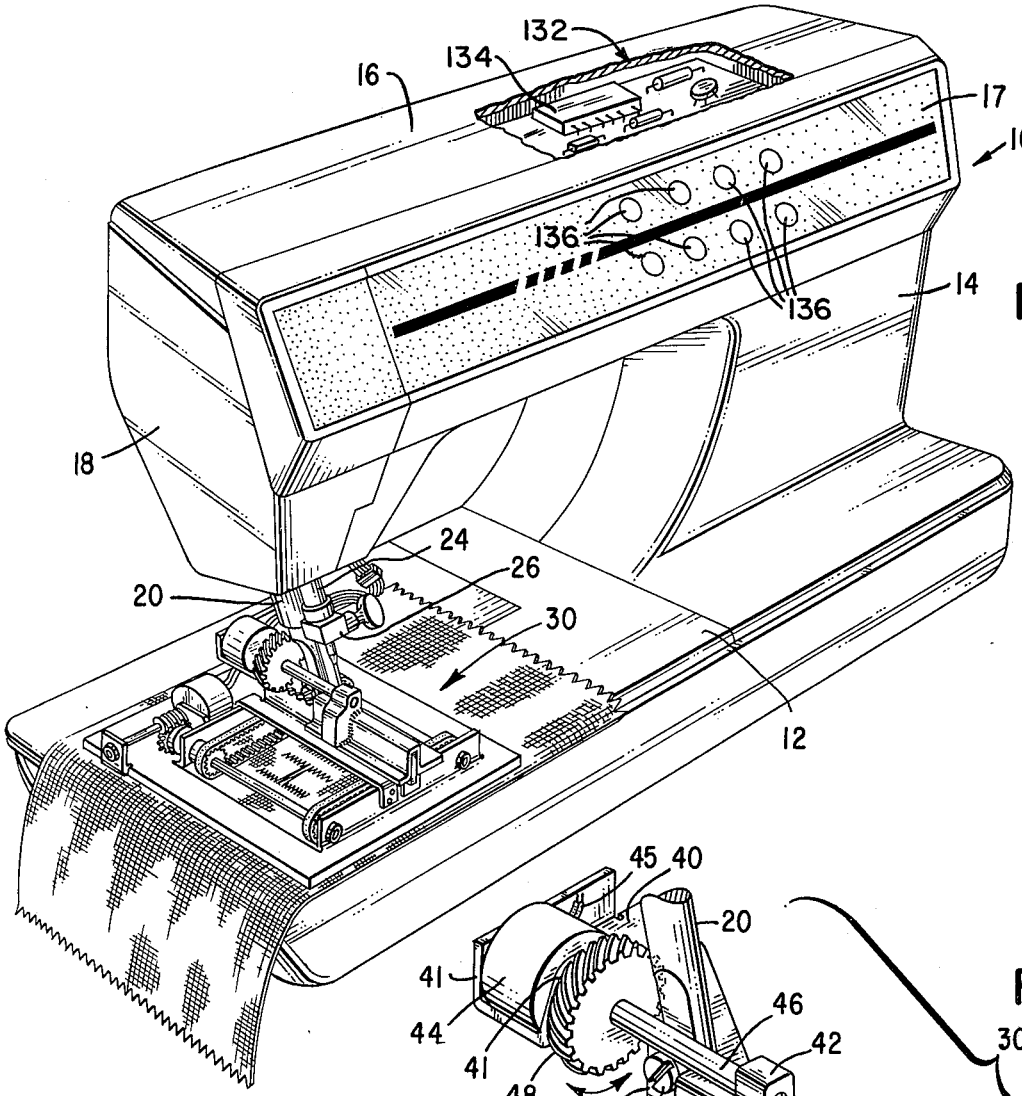
FIG. 1 is a perspective view of a sewing machine, partially broken out, in which the invention may be utilized, with a first embodiment of the invention attached thereto.

Returning to FIG. 2, there is further shown an X axis drive plate 50 having a pair of upstanding ears 52 spaced apart on the drive plate and extending laterally thereon. Bushings 54 are inserted at the ends of the upstanding ears 52, the bushings on one end of the upstanding ears accommodating drive shaft 56 and on the other end accommodating driven shaft 58. Sprockets 60 are supported on the drive and driven shafts 56, 58 adjacent the upstanding ears 52, the sprockets being encircled by feeding belts 62. The bushings 54 are arranged in the upstanding ears 52, and the sprockets 60 are of such a size that the feeding belts 62 extends below the X axis drive plate 50 so that, in actuality, no part of the X axis drive plate is in contact with the work material. A rack 64 straddles the upstanding ears 52 approximately at the mid-point thereof, the rack being fashioned with a bent-over portion 65 having turned down ears 66 which lie adjacent the upstanding ears and are fastened thereto by screws 67. The channel 34 of the Y axis drive plate 32 straddles the rack 64 with the flange 35 of the channel 34 abutting the bent-over portion 65 of the rack. The gear 48 is in mesh with the rack 64, and by virtue of the permanent connection of the Y axis drive plate 32 to the presser bar 20, rotation of the gear 48 by the stepper motor 44 will move the X axis drive plate 50, amd the work material contacted by the feeding belts 62, longitudinally through the sewing machine intermittent to stitching of the work material.

Figure 2:
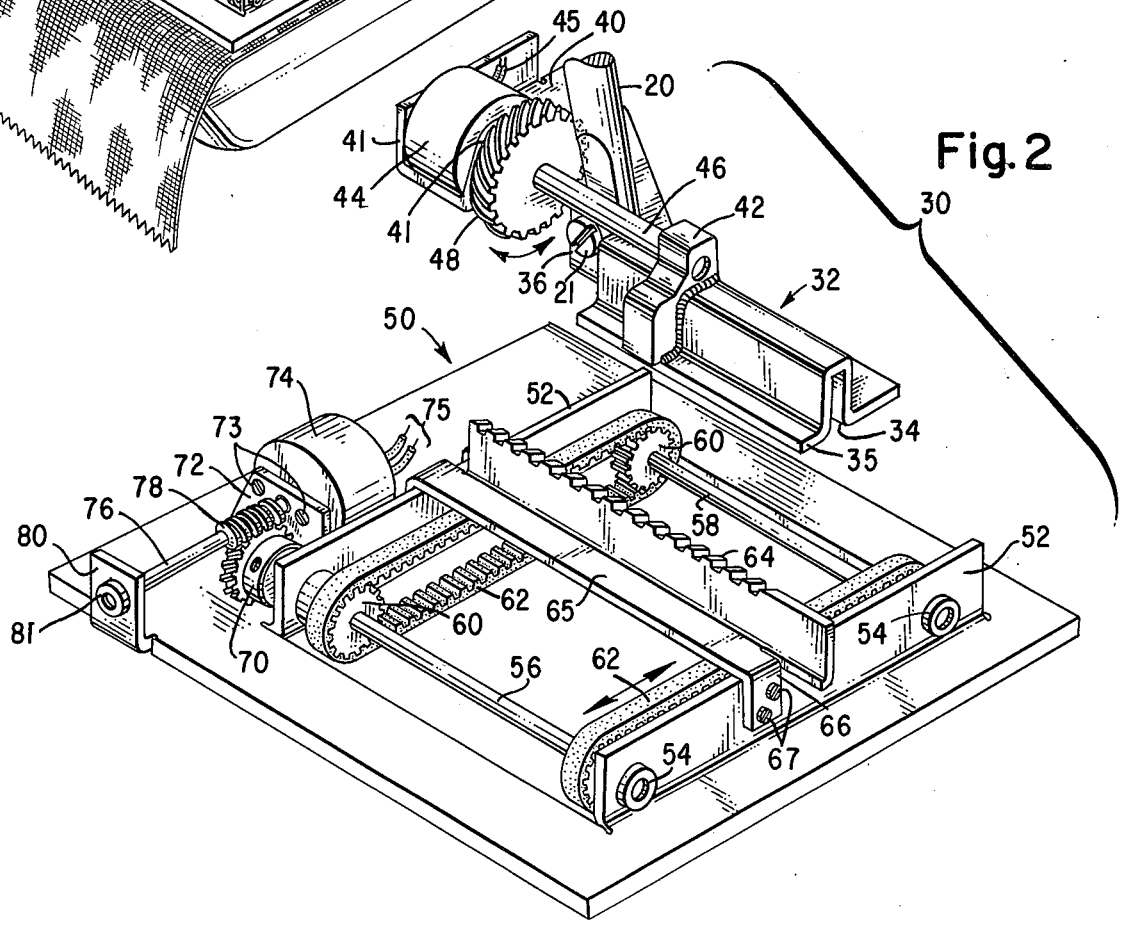
FIG. 2 is an enlarged, partially separated, perspective view of the monogrammer shown in FIG. 1.
Figure 3:
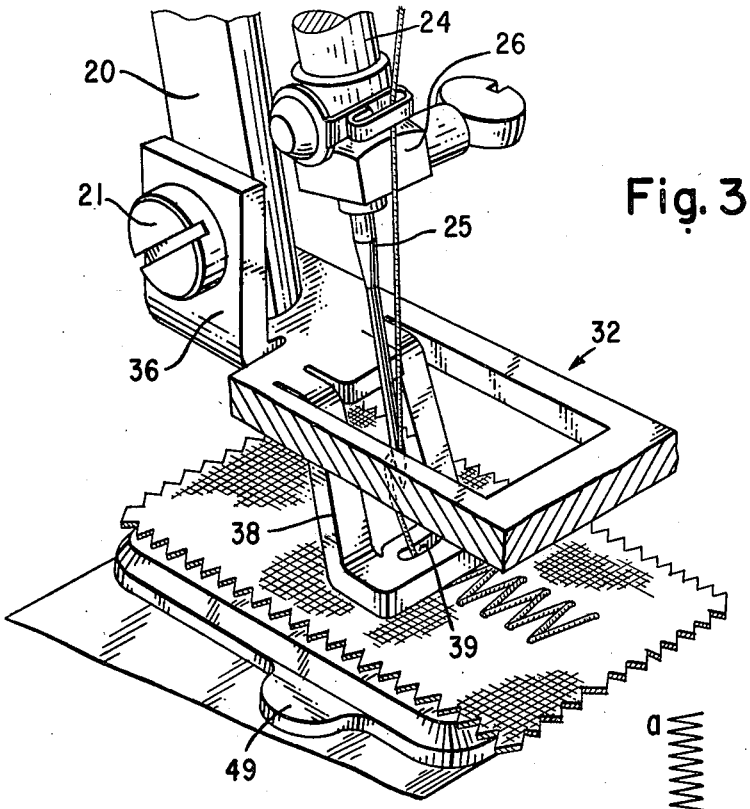
FIG. 3 is a perspective view of a portion of the monogrammer shown in FIGS. 1 and 2 which is not visible therein.

Also visible in FIG. 2, there is supported on the drive shaft 56 externally of the rear upstanding ear 52, a wheel 70. Adjacent to the rear upstanding ear 52, and normal thereto, there is a lanced up lug 72 having affixed thereto as by screws 73 an X axis stepper motor 74. The shaft 76 from the X axis stepper motor 74 extends through the lanced up lug 72 into a shaft support 80 turned up from the edge of the X axis drive plate 50 and having a bearing 81 inserted therein to receive the shaft 76. Supported on the shaft 76 and affixed thereto is a worm 78 meshing with the wheel 70 carried by the drive shaft 56. Thus, as the X axis stepper motor 74 revolves, the wheel 70 and drive shaft 56 is revolved causing the sprockets 60 to move the feeding belts 62. Motion of the feeding belts 62 causes the work material to move laterally through the sewing machine intermittent to stitching thereof. Simultaneously therewith, the Y axis stepper motor 44 may also cause motion of the X axis drive plate 50 in the longitudinal direction through the sewing machine, this combined motion permitting location of the work material wherever necessary for the formation of an ornamental pattern or monogram.

The operation of the monogrammer assembly 30 may now be described. The leads 45, 75 from the Y axis stepper motor 44 and X axis stepper motor 74, respectively, may be of sufficient length and flexibility to permit motion of the Y axis drive plate 32 and X axis drive plate 50 without disturbing the plug-in connection (not shown) of these leads in some readily accessible portion of the sewing machine such as the head end 18 or arm 16 for access with the electronic control 132 internally visible in the broken out portion of the arm. Within the arm, an electronic memory, such as a solid state device 134, may store pattern information or monogramming information selectable by way of push-buttons or touch pads 136 on control panel 17 supported on the arm 16. The device utilized may be an adaptation of the device disclosed in the U.S. Pat. No. 3,872,808, issued on Mar. 25, 1975 to Wurst, which is hereby incorporated by reference herein. Within the head portion 18 there may be supported a solenoid operated skip stitch mechanism such as is disclosed in the U.S. Pat. No. 3,872,809, issued on Mar. 25, 1975 to Adams et al., which is hereby incorporated by reference herein. This device may also be activated by the electronic memory at suitable periods during monogramming or patterning to effect traverse from one complete portion of the monogram or pattern to the starting point of another portion thereof.

Alternatively, a mechanically controlled sewing machine may be used which has a stitch cycle sensor to trigger the release of pattern information to the Y axis stepper motor 44 and X axis stepper motor 74 from a separate auxiliary electronic control for the monogrammer assembly 30. A skip stitch mechanism as disclosed in the above reference patent may be activated by the separate auxiliary electronic control; or the patterns and monograms may include bridging stitching, such as underlining between letters and double stitching to provide a return path, to avoid the use of such a device.

Figure 5:
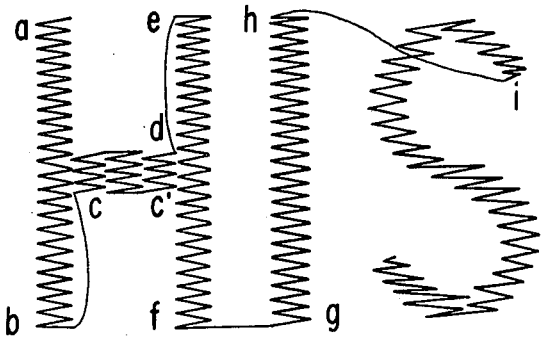

By way of example in FIG. 5 there is shown a frequently used monogram which may be initiated at point a with the sewing machine 10 set at full bight zigzag. A line of the stitches may proceed from a to b by providing, intermittent the stitching, a series of signals from the electronic memory device to the Y axis stepper motor 44 which causes the X axis drive plate 50 to move longitudinally through the machine until the sewing needle 25 is at the point b. At that point, the skip stitch device would be activated and the Y axis stepper motor 44 would be reversed while simultaneously the X axis stepper motor 74 is actuated to bring the work material to a position where the first needle penetration takes place at c in the left needle position. The lateral bar in the H is made by a series of full bight stitches in reverse followed by actuation of the X axis stepper motor 74 to position the previous right needle position into a new left needle position to repeat a series of full bight zigzag stitches in the forward direction followed by a similar maneuver in actuation of several zigzag full bight needle stitches in the reverse direction. The needle bar actuation is again suspended while the Y axis stepper motor 44 and X axis stepper motor 74 are actuated until the sewing needle moves from the position d to the position e. Thereupon, a series of full bight stitches are effected from the position e to the position f with the Y axis stepper motor 44 actuated between stitches. At f, reciprocation of the needle bar 24 is again held in suspension while the X axis stepper motor 74 is actuated to bring the sewing needle 25 from the position f to the position g. Full bight stitching takes place while the Y axis stepper motor 44 is actuated intermittent stitching to bring the X axis drive plate 50 towards the sewing machine operator to effect the stitches from g to h. Again reciprocation of the needle bar 24 is suspended while the X axis stepper motor 74 and the Y axis stepper motor 44 are actuated to bring the sewing needle from h to i. Thereafter, both the Y axis stepper motor 44 and the X axis stepper motor 74 are actuated as required to effect the outline of the curved S. The monogram may be completed by trimming away the joining thread between b and c, e and d, f and g, and h and i. Although in the above explanation the monogram was implemented utilizing the zigzag capability of the needle bar it will be apparent to those skilled in the art that in place of lateral oscillation of the needle bar, the X axis stepper motor 74 may be stepped back and forth in conjunction with stepping of the Y axis stepper motor 44, and accomplish the identical monogram.

Figure 4:
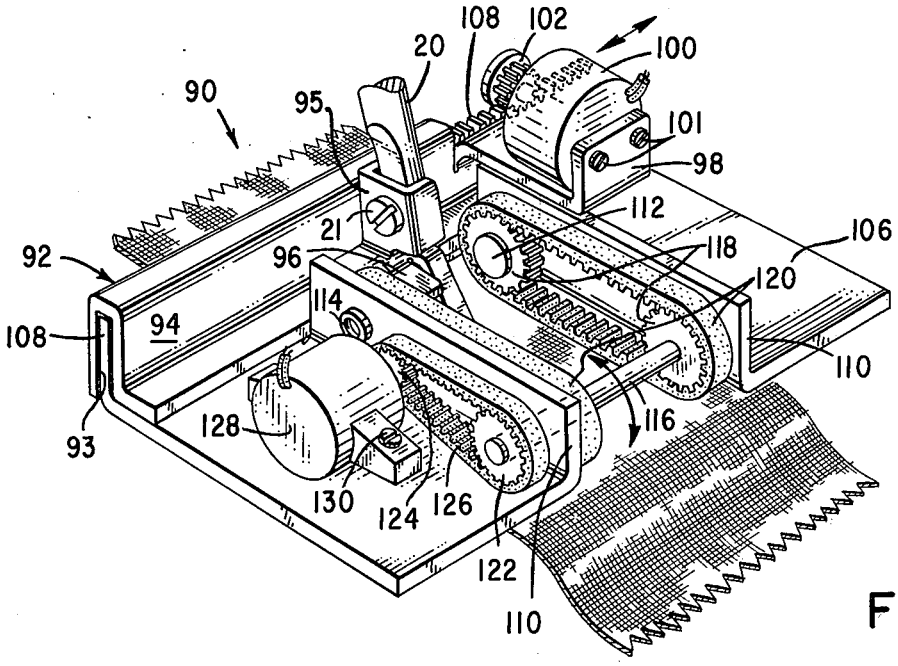
FIG. 4 is an enlarged perspective view of a second embodiment of a monogrammer according to the invention; and, FIG. 5 is a representation of a frequently used monogram indicating how it may be formed in the device.

Referring now to FIG. 4 there is disclosed a second embodiment of the monogrammer assembly in a more compact arrangement so as to be amenable to stitching on tubula fabric. In this second embodiment of a monogrammer assembly 90 the X axis drive plate 92 is fashioned with a channel 93 and a flange 84, from which flange a presser bar lug 85 is upstanding to be attached to the presser bar 20 by presser bar screw 21. As before the X axis drive plate 92 is fashioned with a stripper foot 96 abutting the work material to support the same against the retraction of the sewing needle 25. The X axis drive plate 92 is further fashioned with a support platform 98 which supports an X axis stepper motor 100, attached thereto by screws 101. A pinion 102 is affixed to the shaft of the X axis stepper motor 100.

A Y axis drive plate 106 is fashioned with a rack 108 and two parallel spaced upstanding ears 110 extending substantially normal to the rack. Bushings 114 are spaced on the upstanding ears the rear bushings being threaded to receive shoulder screws 112 on which are supported sprockets 118, whereas the forward bushings receive a shaft 116 also supporting thereon sprockets 118. Feeding belts 120 extend between the sprockets and, as in the previous embodiment, the surface of the belts extend below the Y axis drive plate 106 in order to feed a work material therebeneath. The shaft 116 extends beyond the bushing on one side and receives a further driven sprocket 122, which is connected to a drive sprocket 124 on Y axis stepper motor 128 by a drive belt 126. The Y axis stepper motor 128 is attached to the Y axis drive plate 106 by screws 130, only one of which is shown. In this arrangement, the work material is fed longitudinally through the sewing machine and is also capable of lateral shift. Thus in this embodiment, patterning or monogramming is done longitudinally rather than laterally so as to accomplish continuous monogramming in a compact package. Zig-zag stitching for the monogramming shown in FIG. 5 is effected by actuation of the Y axis stepper motor 128 intermittent to stitching while the needle bar 24 is maintained in one (straight stitch) position. In FIG. 5, a line of zig-zag stitches from a to b is effected by back and forth stepping of the Y axis stepper motor 128 while moving the Y axis drive plate 106 by actuation of the X axis stepper motor 100 in one direction. Return from b to c is effectuated while the skip stitch device is activated and the X axis stepper motor 100 is moved in the reverse direction. Stitching from c to d may be accomplished by actuation of the Y axis stepper motor 128 from c to c' in steps intermittent stitching, and by actuating the X axis stepper motor 100 a small amount and reversing this stitching operation back to a point adjacent c. This may be repeated a sufficient number of times to obtain a pronounced bar, and actuation of the Y axis stepper motor 128 may terminate at d whereupon the skip stitch device is once again actuated while the X axis stepper motor 100 is actuated to move the work material to a position wherein the sewing needle 25 is aligned with e. Stitching from e to f proceeds as from a to b with back and forth stepping of the Y axis stepper motor 128 intermittent stitching along with actuation of the X axis stepper motor 100 in the one direction. The transition from f to g takes place while the skip stitch device is activated by stepping the Y axis stepper motor 128. The remaining portion of the monogram may be completed similarly.

Although the present invention has been described with preferred embodiments it should be understood that many changes and modifications are possible without departing from the spirit of the present invention and the scope of the accompanying claims.

What is claimed is:

1. A work manipulating mechanism for use with a sewing machine having a frame supporting a presser bar, a needle bar, a sewing needle supported on the end of said needle bar, means for supporting said needle bar for endwise reciprocation, actuating means for implementing endwise reciprocation of said needle bar, said frame including a work supporting bed; and an electronic control means for storing signals related to positional coordinates for patterns and monograms, said mechanism comprising:

first means responsive to said signals from said electronic control means for selectively feeding work material in unlimited amount along one axis intermittent generation of stitches; and, second means responsive to said signals from said electronic control means for selectively moving said first means along an axis substantially orthogonal to said one axis intermittent generation of said stiches.

2. A work manipulating mechanism for use with an electronically controlled sewing machine having a frame supporting a presser bar, a needle bar, a sewing needle supported on the end of said needle bar, means for supporting said needle bar for endwise reciprocation, and means for storing electronic signals related to positional coordinates for patterns and monograms, said frame including a work supporting bed, said mechanism comprising:

first means responsive to said electronic signals for selectively feeding work material in unlimited amount along one axis intermittent generation of stitches; and, second means responsive to said electronic signals for selectively moving said first means along an axis substantially orthogonal to said one axis intermittent generation of said stitches.

3. A work manipulating mechanism as claimed in claim 2 wherein said first means is implemented by a first drive plate having a top and bottom surface and with an opening therethrough, a pair of parallel shafts supported by said first drive plate spaced from said top surface and from each other above said opening, at least one pair of sprockets supported by said parallel shafts, an endless belt extending about said sprockets, the thickness of the belt and radii of the sprockets being of such a combined dimension as to extend through said opening beyond said bottom surface to said work supporting bed, and first means for turning said shafts a selected amount in a selected direction in accordance with instructions from said electronic signal storing means.

4. A work manipulating mechanism as claimed in claim 3 wherein said first means further comprises a rack supported by said first drive plate above said endless belt and said top surface, and wherein said second means is implemented by a second drive plate supported by said rack, said second drive plate having an ear detachably secured to said presser bar, a shaft, means for supporting said shaft parallel to and spaced from said rack, a gear supported on said shaft for engagement with said rack, and second means for turning said shaft in a selected amount in a selected direction in accordance with instructions from said electronic signal storing means whereby said first drive plate is shiftable a limited amount while feeding a work material therethrough.

5. A work manipulating mechanism as claimed in claim 4 wherein said first and second means for turning said shafts are implemented by stepper motors responsive to signals from said electronic signal storing means for positioning a work material.

* * * * *